United States Patent [19]

Hervat et al.

[11] Patent Number: 4,863,405

[45] Date of Patent: Sep. 5, 1989

[54] OUTBOARD MOTOR TILT LOCK DEVICE

[75] Inventors: John C. Hervat, Kenosha, Wis.; Matthew H. Mondek, Wonder Lake; Harold L. Osborn, Winthrop Harbor, both of Ill.; Gregory M. Umek, Waukegan, Ill.

[73] Assignee: Outboard Marine Corporation, Waukegan, Ill.

[21] Appl. No.: 184,405

[22] Filed: Apr. 20, 1988

[51] Int. Cl.[4] ..... B63H 21/26

[52] U.S. Cl. ..... 440/53; 440/900; 248/641

[58] Field of Search ..... 440/55, 56, 63, 900; 248/641, 643; 16/347

[56] References Cited

U.S. PATENT DOCUMENTS

| | | | |
|---|---|---|---|
| 3,016,869 | 1/1962 | Anderson et al. | 115/17 |
| 3,371,893 | 3/1968 | Blanchard, Jr. | 248/4 |
| 4,099,479 | 7/1978 | Arimitau | 115/41 |
| 4,419,083 | 12/1983 | Taguchi | 440/56 |
| 4,637,800 | 1/1987 | Slattery | 440/55 |
| 4,676,757 | 6/1987 | Ruge et al. | 440/55 |

FOREIGN PATENT DOCUMENTS

| | | | |
|---|---|---|---|
| 0071798 | 4/1987 | Japan | 440/55 |

*Primary Examiner*—Joseph F. Peters, Jr.
*Assistant Examiner*—Edwin L. Swinehart
*Attorney, Agent, or Firm*—Michael, Best & Friedrich

[57] ABSTRACT

A marine propulsion device comprising a transom bracket adapted to be mounted on the transom of a boat and having a side and upper surface, the marine propulsion device further comprising a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, a tilt lock shaft having first and second ends extending through the swivel bracket along a second generally horizontal axis spaced rearwardly from and substantially parallel to the tilt axis, a lever member mounted on the shaft and including a contact pad extending parallel to and radially offset from the second axis and further including at least one leg extending substantially perpendicularly relative to the contact pad, and manually operable structure for rotating the tilt lock shaft between a lock position, wherein the leg extends along the side of the transom bracket and the contact pad engages the upper surface of the transom bracket to prevent movement of the swivel bracket from the raised position to the operating position, and a release position wherein the contact pad disengages the transom bracket to permit the swivel bracket to move from the raised position to the operating position.

25 Claims, 2 Drawing Sheets

OUTBOARD MOTOR TILT LOCK DEVICE

BACKGROUND OF THE INVENTION

This invention relates to marine propulsion devices and, more particularly, to means for holding the swivel bracket of a marine propulsion device mounting assembly in the raised position.

A typical outboard motor includes a mounting assembly having a transom bracket adapted to be mounted on the transom of a boat, and a swivel bracket mounted on the transom bracket for pivotal movement, between an operating position and a raised position, relative to the transom bracket about a generally horizontal tilt axis. Many means are known for releaseably holding the swivel bracket in the raised position Such means sometimes have complicated constructions and/or are difficult to operate.

Attention is directed to the following U.S. Pat. Nos.

| U.S. Pat. No. | Inventor | Issued |
|---|---|---|
| 4,676,757 | Ruge et al. | June 30, 1987 |
| 4,099,479 | Arimitsu | June 11, 1978 |
| 3,371,893 | C. E. Blanchard, Jr. | March 5, 1968 |
| 3,016,869 | G. R. Anderson et al. | January 16, 1962 |
| 4,419,083 | Taguchi | December 6, 1983 |
| 4,637,800 | Slattery | January 20, 1987 |

SUMMARY OF THE INVENTION

The invention provides a marine propulsion device comprising a transom bracket adapted to be mounted on a transom of a boat and having a side and an upper surface, the marine propulsion device further comprising a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, a tilt lock shaft having first and second ends extending through the swivel bracket along a second generally horizontal axis spaced rearwardly from and substantially parallel to the tilt axis, a lever member mounted on one of said first or second ends and including a contact pad extending parallel to and radially offset from the second axis and further including at least one leg extending substantially perpendicularly relative to the contact pad, and manually operable means for rotating the tilt lock shaft between a lock position, wherein the leg extends along the side of the transom bracket and the contact pad engages the upper surface of the transom bracket to prevent movement of the swivel bracket from the raised position to the operating position, and a release position wherein the contact pad disengages the transom bracket to permit the swivel bracket to move from the raised position to the operating position.

In one embodiment, the marine propulsion device further includes detent means for releaseably securing the tilt lock shaft in either of the lock or release positions.

In one embodiment, the marine propulsion device includes a pair of lever members mounted on the first and second ends of the tilt lock shaft.

The invention also provides a tilt lock assembly adapted for use with a marine propulsion device having a transom bracket and a swivel bracket mounted on the transom bracket for pivotal movement relative to the transom bracket about a generally horizontal tilt axis and between an operating position and a raised position, the tilt lock assembly comprising an elongate cylindrical shaft having a longitudinal axis and first and second ends, and a pair of generally L-shaped lever members mounted on the first and second ends, each of the lever members including a radial portion extending radially outwardly from the shaft and an axial portion offset radially from the shaft and extending perpendicularly outwardly from the first portion in a direction substantially parallel to the shaft, at least one of the axial portions being adapted to be gripped by a user's hand.

The invention also provides a marine propulsion device comprising a transom bracket adapted to be mounted on a transom of a boat and having a pair of spaced side members having upper edge surfaces and opposed side surfaces, the marine propulsion device further comprising a swivel bracket mounted on the transom bracket for pivotal movement relative to the transom bracket about a generally horizontal tilt axis and between an operating position and a raised position, a propulsion unit including a rotatably mounted propeller and being mounted on the swivel bracket for pivotal movement relative to the swivel bracket about a generally vertical steering axis, and a tilt lock assembly, the tilt lock assembly comprising an elongate cylindrical shaft extending through and rotatably supported by the swivel bracket along a second generally horizontal axis spaced rearwardly from and substantially parallel to the tilt axis, and a pair of generally L-shaped lever members mounted on the first and second ends, each of the lever members including a radial portion extending radially outwardly from the shaft and an axial portion offset radially from the shaft and extending perpendicularly outwardly from the first portion in a direction substantially parallel to the shaft so as to be capable of being moved into engagement with the upper edge surfaces of the transom bracket side members, at least one of the axial portions being adapted to be gripped by the hand, and detent means for establishing a first rotational position of the shaft wherein the axial portions of the first and second lever members engaged the upper edge surfaces of the transom bracket side members when the swivel bracket is in the raised position, and a second rotational position wherein the axial portions of the first and second lever members disengage the upper edge surfaces of the transom bracket side members so as to permit movement of the swivel bracket from the raised position to the operating position.

A principal feature of the invention is the provision of a tilt lock mechanism wherein a lever member includes a leg portion adapted to engage the side of a transom bracket in the event there is sufficient load on the tilt lock mechanism to cause the lever member to deflect outwardly relative to the transom bracket.

Another principal feature of the invention is the provision of a tilt lock mechanism wherein a pair of lever members engage opposite sides of the transom bracket to more evenly distribute the load on the tilt lock mechanism and the transom bracket.

Another principal feature of the invention is the provision of a tilt lock mechanism wherein a tilt lock shaft is axially biased so as to minimize noise and vibration under operating conditions.

Another principal feature of the invention is the provision of a tilt lock mechanism wherein a detent spring is included so as to provide positively felt indications of when the tilt lock mechanism is fully within a locked or unlocked condition.

Other principal features and advantages of the invention will become apparent to those skilled in the art upon review of the following detailed description, claims and drawings.

Figure 1:
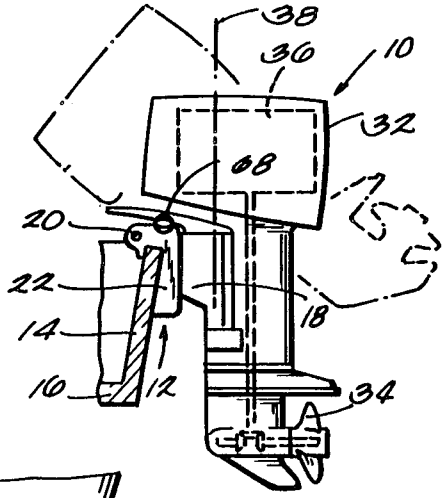
FIG. 1 is a side elevational view of a marine propulsion device embodying various of the features of the invention and including a swivel bracket movable between an operating position and a raised position.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 3:
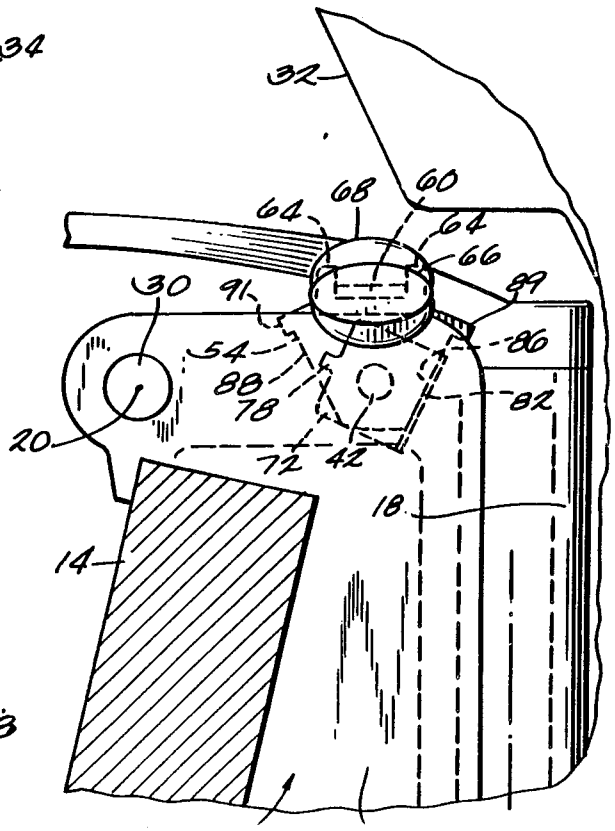
FIG. 3 is a partial, side view of the marine propulsion device showing the swivel bracket in the operating position.
Figure 5:
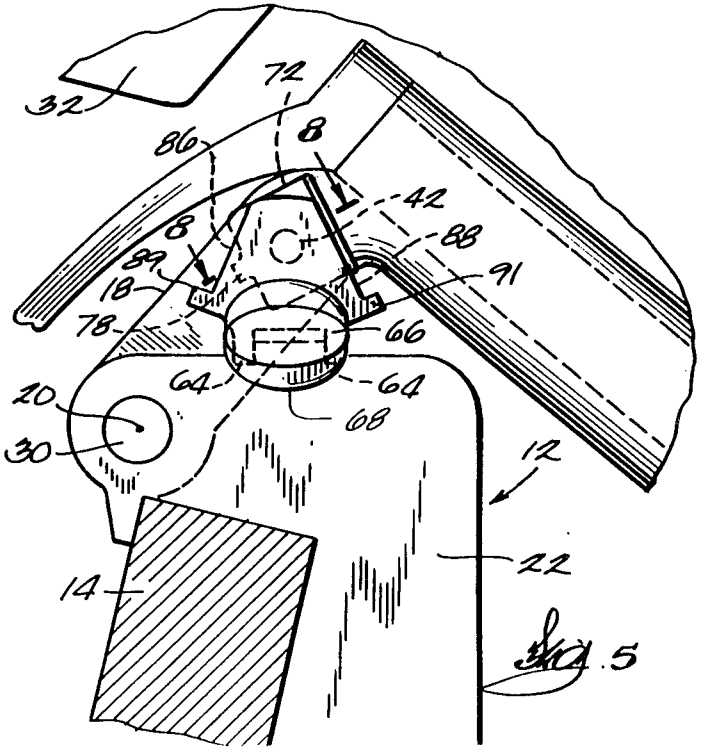
FIG. 5 is a partial, side view, similar to FIG. 3, showing the swivel bracket in the raised position
Figure 4:
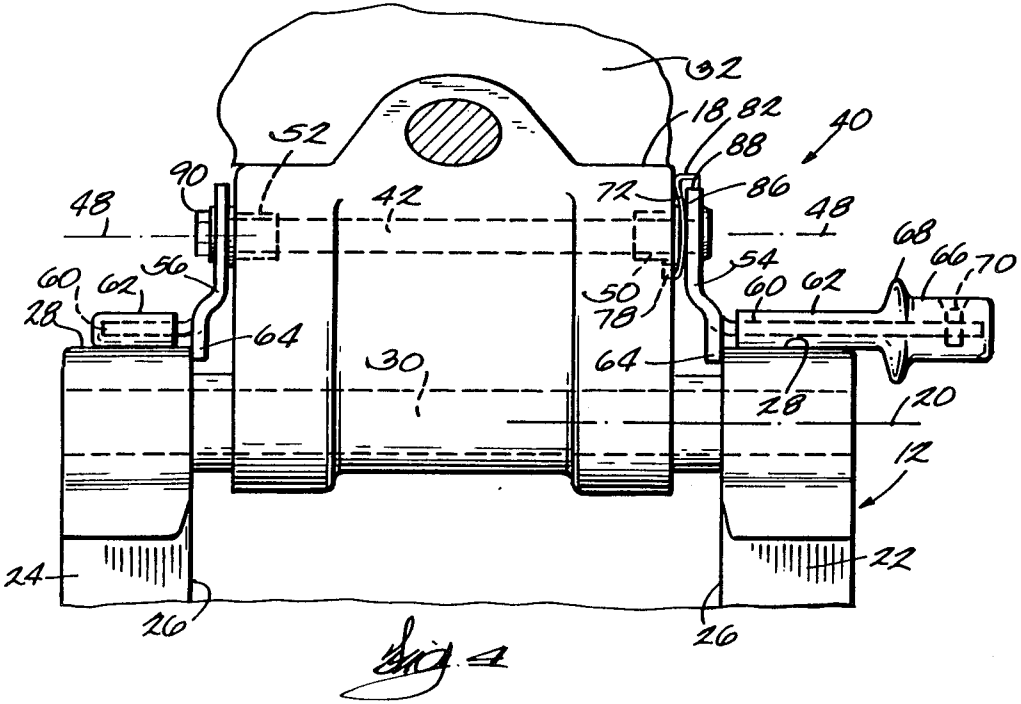
FIG. 4 is a partial, front view of the marine propulsion device, similar to FIG. 2, showing the swivel bracket in the raised position.

A marine propulsion device 10 embodying the invention is illustrated in the drawings. As best shown in FIG. 1, the marine propulsion device 10 comprises a transom bracket 12 mounted on the transom 14 of a boat 16 and a swivel bracket 18 mounted on the transom bracket 12 for pivotal movement relative to the transom bracket about a generally horizontal tilt axis 20 and between an operating position (FIGS. 1–3) and a raised position (FIGS. 4 and 5). While any suitable transom bracket and swivel bracket arrangement can be used, in the preferred embodiment, the transom bracket 12 includes a pair of spaced apart side members 22, 24 (FIG. 27), each having an inner side surface 26 and an upper edge surface 28. The swivel bracket 18 extends between the side members 22, 24 of the transom bracket 12 and is pivotally connected to the transom bracket 12 for rotation about the tilt axis 20 by a tilt pin 30 (FIG. 3).

The marine propulsion device 10 also comprises a propulsion unit 32 including a rotatably mounted propeller 34, and an engine 36 drivingly connected to the propeller 34. The propulsion unit 32 is mounted on the swivel bracket 18 for pivotal movement relative to the swivel bracket 18 about a generally vertical steering axis 38 and for common movement with the swivel bracket 18 about the tilt axis 20. In the preferred embodiment, the swivel bracket 18 and the propulsion unit 32 have a combined center of gravity which is located rearwardly of the tilt axis 20 when the swivel bracket 18 is in the raised position, so that the swivel bracket 18 and the propulsion unit 32 tend to rotate clockwise, as viewed in FIG. 1, when the swivel bracket 18 is in the raised position.

To selectively lock the marine propulsion device 10 in the raised position, as, for example, when the boat 16 is being transported on a trailer, the marine propulsion device 10 includes a manually operable tilt lock assembly 40. The tilt lock assembly 40 includes an elongate, generally cylindrical, tilt lock shaft 42, having first and second ends 44, 46, extending through the swivel bracket 18 along a generally horizontal longitudinal axis 48 spaced rearwardly from and substantially parallel to the tilt axis 20. Preferably, the tilt lock shaft 42 is formed of a hard, durable material, such as steel.

Figure 2:
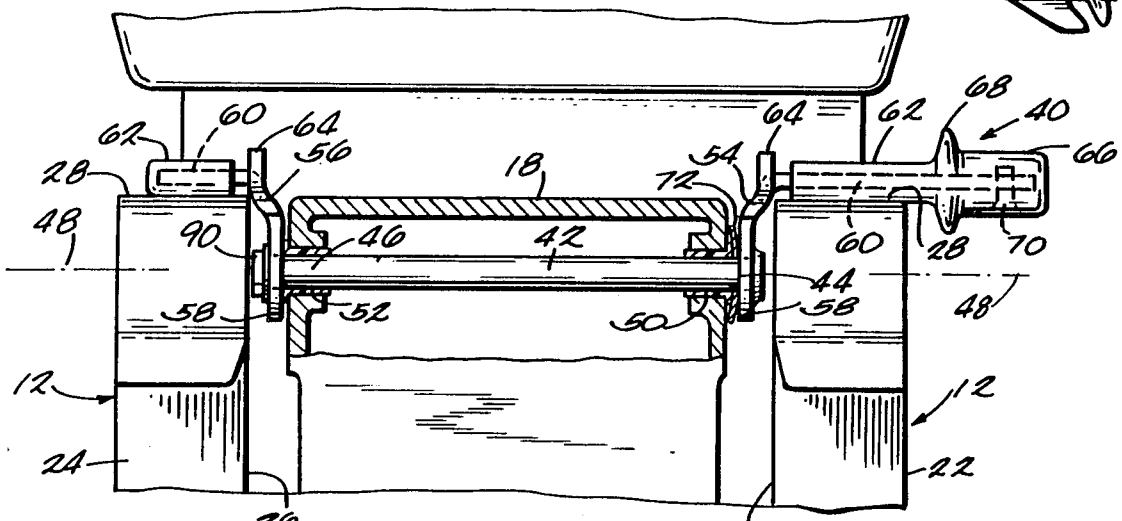
FIG. 2 is a partial, front view of the marine propulsion device showing an outboard motor tilt lock assembly constructed in accordance with one aspect of the invention.

As best seen in FIG. 2, the length of the tilt lock shaft 42 is such that the first and second ends 44, 46 project beyond the sides of the swivel bracket 18, but not so far as to interfere with the transom bracket 12 when the marine propulsion device 10 is in the lowered position. A pair of cylindrical bushings 50, 52, preferably formed of a low-friction plastic, are inserted in openings formed on opposite sides of the swivel bracket 18 so as to support the tilt lock shaft 42 for rotation relative to the swivel bracket 18.

The tilt lock assembly further includes a pair of generally L-shaped lever members 54, 56 mounted on the fist and second ends 44, 46 of the tilt lock shaft 42. Each of the lever members 54, 56 is preferably formed of a hard, durable material, such as steel, and includes a radial portion 58 extending radially outwardly from the tilt lock shaft 42, and a contact pad or axial portion 60 radially offset from, and extending substantially parallel to, the longitudinal axis 48 of the tilt lock shaft 42. As best seen in FIGS. 2 and 4, the lever members 54, 56 are positioned on the tilt lock shaft 42 so that the axial portions 60 are substantially co-linear with each other and extend outwardly from the opposite sides of the swivel bracket 18. In addition, the axial portions 60 are positioned so as to be engageable with the upper edge surfaces 28 of the transom bracket side members 22, 24. Preferably, each contact pad or axial portion 60 includes a plastic sleeve 62 forming, on each side of the axial portion 60, a durable contact surface suitable for engaging the upper edge 28 of each transom bracket side member 22, 24.

Referring further to FIGS. 2–5, each of the lever members 54, 56 further includes a pair of legs or tabs 64 formed on opposite sides of each contact pad or axial portion 60 adjacent the juncture of each axial portion 60 with its associated radial portion 58. As best seen in FIGS. 2 and 4, the legs 64 are oriented substantially perpendicularly to the axial portions 60, and the spacing between the legs 64 of the lever members 54, 56 is slightly less than the distance between the inner side faces 26 of the transom bracket side members 22, 24.

In accordance with one aspect of the invention, manually operable means are provided for rotating the tilt lock shaft 42 between a lock position (FIGS. 4 and 5), wherein the legs 64 of the lever members 54, 56 extend along the inner side surfaces 26 of the transom bracket side members 22, 24 while the contact pads or axial portions 60 of the lever members 54, 56 engage the upper edge surfaces 28 of the transom bracket side members 22, 24 to thereby prevent movement of the swivel bracket 18 from the raised position to the operating position, and a release position (FIGS. 2 and 3), wherein the contact pads or axial portions 60 of the lever members 54, 56 disengage the transom bracket side members 22, 24 to permit the swivel bracket 18 to move from the raised position to the operating position. While various suitable means can be used, in the illustrated construction, the manually operable means comprises a user-graspable handle portion 66 formed at the distal end of the axial portion 60 of one of the lever members 54. Preferably, the axial portion 60 of one of the lever members 54 is lengthened to extend beyond the outer side of the adjacent transom bracket side member 22, as is the plastic sleeve 62 mounted on the extended axial portion 60. In addition, a guard flange 68 is formed on the plastic sleeve outwardly of the transom bracket 12 to define the outer handle portion 66 and to prevent an operator's fingers from extending into the area adjacent the upper edge surface 28 of the transom bracket side member 22. Preferably, the elongated sleeve 62 is secured to the axial portion 60 by means of a screw or other fastener 70.

To place the marine propulsion device 10 in the lowered or operating position, the tilt lock shaft 42 is rotated around the axis 48 to the position shown in FIG. 2 wherein the contact pads or axial portions 60 of the lever members 54, 56 are above the longitudinal axis 48 of the tilt lock shaft 42. This permits the swivel bracket 18 to rotate downwardly relative to the transom bracket 12 to the operating position shown in FIGS. 2 and 3.

To lock the marine propulsion device 10 in the raised position, the marine propulsion device 10 is first manually rotated around the tilt axis 20 to the raised position, after which the tilt lock shaft 42 is manually rotated, by means of the handle 66, so as to place the contact pads or axial portions 60 of the lever members 54, 56 below the longitudinal axis 48 of the tilt lock shaft 42. When the tilt lock shaft 42 is so rotated, the contact pads 60 rest on the upper edge surfaces 28 of the transom bracket side members 22, 24, as shown in FIGS. 4 and 5, and prevent downward rotation of the swivel bracket 18 relative to the transom bracket 12 around the tilt axis 20.

To release the tilt lock mechanism 40, the marine propulsion device 10 is manually raised slightly above the raised position so as to lift the contact pads 60 slightly above the transom bracket side members 22, 24, after which the tilt lock shaft 42 is manually rotated so as to place the contact pads 60 above the axis 48 of the tilt lock shaft 42. Thereafter, the marine propulsion device can be lowered to the operating position.

When the tilt lock assembly 40 is in the lock position, the legs 64 of the lever members 54, 56 extend alongside, and closely adjacent, the inner side surfaces 26 of the transom bracket side members 22, 24 as best seen in FIG. 4. When so positioned, the legs 64 prevent the level members 54, 56 from splaying outwardly under loads imposed by the propulsion unit 32 as, for example, when the boat 16 is transported on a trailer with the propulsion unit 32 in the raised position.

Figure 8:
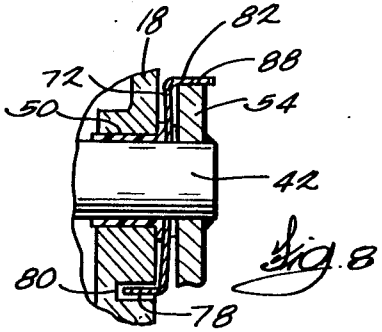
FIG. 8 is a cross-sectional view taken along line 8—8 in FIG. 5.
Figure 7:
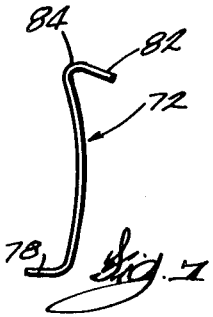
FIG. 7 is a cross-sectional view taken along line 7—7 in FIG. 6.
Figure 6:
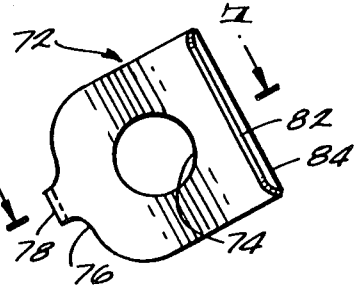
FIG. 6 is a front elevational view of a detent spring incorporated in the tilt lock device.

To provide positively felt indications of when the tilt lock shaft 42 is within either of the lock or release positions shown, respectively, in FIGS. 5 and 3, the tilt lock assembly 40 further includes detent means adapted to engage the swivel bracket 18 and operable to retain the tilt lock shaft 42 in either of two predetermined rotational positions relative to the swivel bracket 18. While various suitable means can be used, in the illustrated embodiment, such means takes the form of a detent spring 72 formed of spring steel or similar material. As shown in FIGS. 6–8, the detent spring 72 is adapted, by means of a central aperture 74, to encircle the tilt lock shaft 42, and is arcuate in a plane oriented substantially perpendicularly to the tilt lock shaft 42. In addition, one edge 76 of the detent spring 72 includes an outwardly turned lip or retaining tab 78 adapted to be received in a recess 80 formed in the side of the swivel bracket side member 22 so as to fix the detent spring 72 against rotation relative to the swivel bracket 18. Opposite the retaining tab 78, the detent spring 72 includes an additional lip 82, extending in the opposite direction along substantially an entire edge 84 of the detent spring 72.

In use, the detent spring 72 is positioned around the tilt lock shaft 42 between the outer face of one side of the swivel bracket 18 and the inner face of one of the lever members 54. In addition, at least one of the lever members 54 includes a pair of angularly offset flat edges 86, 88 adapted to be engaged by the additional lip 82 of the detent spring 72 when the tilt lock shaft 42 is in either of the lock or release positions. When the tilt lock shaft is rotated to the release position shown in FIGS. 2 and 3, one of the flat edges 86 of the lever member 54 engages the turned lip 82 of the detent spring 72. Through action of the detent spring 72, the tilt lock shaft 42 is thus releaseably retained in the release position. When the tilt lock shaft 42 is manually rotated to the lock position, the other edge 88 of the lever member 54 is rotated into engagement with the outwardly turned lip 82 of the detent spring 72. This has the effect of releaseably securing the tilt lock shaft 42 in the lock position. Preferably, a pair of tabs 89, 91 are formed adjacent the opposite ends of the flat edges 86, 88 to prevent over-rotation of the tilt lock shaft 42 beyond the lock and release positions.

Because of the arcuate shape of the detent spring 72 along the direction perpendicular to the longitudinal axis 48 of the tilt lock shaft 42, the detent spring 72, when compressed between the outer side of the swivel bracket 18 and the inner face of the lever member 54, provides an axially directed pre-load on the tilt lock shaft 42 and thus functions to reduce vibration and noise while the marine propulsion device 10 is in operation. Preferably, the lever member 54 nearest the detent spring 72 is permanently mounted to the tilt lock shaft 42 by means of welding, while the opposite lever member 56 is removably mounted to the shaft 42 by means of a detachable threaded fastener such as a bolt or screw 90. This permits convenient assembly and disassembly of the tilt lock mechanism 40 and further permits the detent spring 72 to be axially compressed as the fastener 90 is tightened.

Various other features and advantages of the invention are set forth in the following claims.

We claim:

1. A marine propulsion device comprising a transom bracket adapted to be mounted on a transom of a boat and having a side and an upper surface, said marine propulsion device further comprising, a swivel bracket mounted on said transom bracket for pivotal movement relative to said transom bracket about a generally horizontal tilt axis and between an operating position and a raised position, a propulsion unit including a rotatably mounted propeller and being mounted on said swivel bracket for pivotal movement relative to said swivel bracket about a generally vertical steering axis, a tilt lock shaft having first and second ends extending through said swivel bracket along a second generally horizontal axis spaced rearwardly from and substantially parallel to said tilt axis, a lever member mounted on one of said first or second ends and including a contact pad extending parallel to and radially offset from said second axis and further including at least one leg extending substantially perpendicularly relative to said contact pad, and manually operable means for rotating said tilt lock shaft between a lock position, wherein said leg extends along said side of said transom bracket and said contact pad engages said upper surface of said transom bracket to prevent movement of said swivel bracket from said raised position to said operating position, and a release position wherein said contact pad disengages said transom bracket to permit said swivel bracket to move from said raised position to said operating position.

2. A marine propulsion device in accordance with claim 1 wherein said lever member comprises a substantially L-shaped member having a radial portion adapted to extend radially outwardly from said tilt lock shaft and an axial portion oriented substantially perpendicularly relative to said radial portion, said axial portion including said contact pad.

3. A marine propulsion device in accordance with claim 2 wherein said leg extends substantially radially outwardly from said tilt lock shaft when said lever member is mounted on one end of said tilt lock shaft and is positioned adjacent the juncture of said axial portion with said radial portion.

4. A marine propulsion device in accordance with claim 1 further comprising detent means for releaseably securing said tilt shaft in either of said lock and release positions.

5. A marine propulsion device in accordance with claim 4 wherein said detent means includes a detent spring positioned between said swivel bracket and said lever member.

6. A marine propulsion device in accordance with claim 5 wherein said lever member includes a pair of angularly displaced flats and wherein said detent spring is substantially stationary relative to said swivel bracket and is adapted to engage one or the other of said flats when said tilt lock shaft is in said lock position or said release position.

7. A marine propulsion device in accordance with claim 6 wherein said detent spring is further adapted to bias said tilt lock shaft in an axial direction relative to said swivel bracket.

8. A marine propulsion device in accordance with claim 3 wherein said marine propulsion device further includes an additional lever member mounted on the other of said first or second ends.

9. A marine propulsion device in accordance with claim 8 wherein said manually operable means includes an elongate user-graspable handle extending axially outwardly from said contact pad of one of said lever members.

10. A tilt lock assembly adapted for use with a marine propulsion device having a transom bracket and a swivel bracket mounted on the transom bracket for pivotal movement relative to the transom bracket about a generally horizontal tilt axis and between an operating position and a raised position, said tilt lock assembly comprising an elongate cylindrical shaft having a longitudinal axis and first and second ends, and a pair of generally L-shaped lever members mounted on said first and second ends, each of said lever members including a radial portion extending radially outwardly from said shaft and an axial portion offset radially from said shaft and extending perpendicularly outwardly from said first portion in a direction substantially parallel to said shaft, one of said axial portions extending axially outwardly beyond the transom bracket and being adapted to be gripped by a user's hand.

11. A tilt block assembly in accordance with claim 10 wherein each of said generally L-shaped lever members additionally includes at least one outwardly extending leg oriented substantially radially relative to said shaft.

12. A tilt block assembly adapted for use with a marine propulsion device having a transom bracket and a swivel bracket mounted on the transom bracket for pivotal movement relative to the transom bracket about a generally horizontal tilt axis and between an operating position and a raised position, said tilt lock assembly comprising an elongate cylindrical shaft having a longitudinal axis and first and second ends, and a pair of generally L-shaped lever members mounted on said first and second ends, each of said L-shaped lever members including a radial portion extending radially outwardly from said shaft, an axial portion offset radially from said shaft and extending perpendicularly outwardly from said first portion in a direction substantially parallel to said shaft, at least one of said axial portions being adapted to be gripped by a user's hand, and a pair of outwardly extending legs oriented substantially radially relative to said shaft.

13. A tilt lock assembly in accordance with claim 12 wherein said pair of legs included in each of said L-shaped lever members are formed adjacent the juncture of said axial portion with said radial portion and on opposite sides of said axial portion.

14. A tilt block assembly adapted for use with a marine propulsion device having a transom bracket and a swivel bracket mounted on the transom bracket for pivotal movement relative to the transom bracket about a generally horizontal tilt axis and between an operating position and a raised position, said tilt lock assembly comprising an elongate cylindrical shaft having a longitudinal axis and first and second ends, a pair of generally L-shaped lever members mounted on said first and second ends, each of said lever members including a radial portion extending radially outwardly from said shaft and an axial portion offset radially from said shaft and extending perpendicularly outwardly from said first portion in a direction substantially parallel to said shaft, at least one of said axial portions being adapted to be gripped by a user's hand, and detent means adapted to engage said swivel bracket and operate to retain said cylindrical shaft in either of two predetermined rotational positions relative to the swivel bracket.

15. A tilt lock assembly in accordance with claim 14 wherein said detent means includes a detent spring adapted to simultaneously engage the swivel bracket and one of said L-shaped lever members.

16. A tilt lock assembly in accordance with claim 15 wherein one of said L-shaped lever members includes a pair of angularly offset flats and wherein said detent spring is adapted to engage one or the other of said flats when said cylindrical shaft is in one or the other of said predetermined angular positions relative to the swivel bracket.

17. A tilt lock assembly in accordance with claim 16 wherein said detent spring is further adapted to bias said cylindrical shaft axially relative to the swivel bracket.

18. A marine propulsion device comprising a transom bracket adapted to be mounted on a transom of a boat and having a pair of spaced side members having upper edge surfaces and opposed side surfaces, said marine propulsion device further comprising, a swivel bracket mounted on said transom bracket for pivotal movement relative to said transom bracket about a generally horizontal tilt axis and between an operating position and a raised position, a propulsion unit including a rotatably mounted propeller and being mounted on said swivel bracket for pivotal movement relative to said swivel bracket about a generally vertical steering axis, and a tilt lock assembly, said tilt lock assembly comprising an elongate cylindrical shaft extending through and rotatably supported by said swivel bracket along a second generally horizontal axis spaced rearwardly from and substantially parallel to said tilt axis, and a pair of generally L-shaped lever members mounted on said first and second ends, each of said lever members including a radial portion extending radially outwardly from said shaft and an axial portion offset radially from said shaft and extending perpendicularly outwardly from said first portion in a direction substantially parallel to said shaft so as to be capable of being moved into engagement with said upper edge surfaces of said transom bracket side members, at least one of said axial portions being adapted to be gripped by the hand, and detent means for establishing a first rotational position of said shaft wherein said axial portions of said first and second lever members engage said upper edge surfaces of said transom bracket side members when said swivel bracket is in said raised position, and a second rotational position wherein said axial portions of said first and second lever members disengage said upper edge surfaces of said transom bracket side members so as to permit movement of said swivel bracket from said raised position to said operating position.

19. A marine propulsion device in accordance with claim 18 wherein each of said generally L-shaped lever members includes a radially outwardly extending leg portion adapted to extend closely adjacent one of said opposed side surfaces of said transom bracket when said shaft is in said first rotational position.

20. A marine propulsion device in accordance with claim 19 wherein each of said generally L-shaped lever members includes a pair of said legs located adjacent the juncture of said axial portion with said radial portion and on opposite sides of said axial portion.

21. A marine propulsion device in accordance with claim 20 wherein said detent means comprises a detent spring adapted to simultaneously engage said swivel bracket and one of said generally L-shaped lever members.

22. A marine propulsion device in accordance with claim 21 wherein said L-shaped lever member engaged by said detent spring includes a first flat edge adapted to be engaged by said detent spring when said shaft is in said first rotational position, and further includes a second flat edge adapted to be engaged by said detent spring when said shaft is in said second rotational position.

23. A marine propulsion device in accordance with claim 22 wherein said detent spring comprises a leaf-like structure adapted to encircle said shaft and having an outwardly turned lip adapted to engage either of said flat edges of said L-shaped lever member.

24. A marine propulsion device in accordance with claim 23 wherein said swivel bracket includes a recess and wherein said detent spring includes a tab adapted to be received in said recess so as to lock said detent spring against rotation relative to said swivel bracket around said shaft.

25. A marine propulsion device in accordance with claim 24 wherein said detent spring is bowed so as to bias said shaft axially relative to said swivel bracket.

* * * * *